US011524385B2

(12) United States Patent
McCormick

(10) Patent No.: US 11,524,385 B2
(45) Date of Patent: Dec. 13, 2022

(54) CMP POLISHING PAD WITH LOBED PROTRUDING STRUCTURES

(71) Applicant: Rohm and Haas Electronic Materials CMP Holdings, Inc., Newark, DE (US)

(72) Inventor: John R. McCormick, Exton, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 682 days.

(21) Appl. No.: 16/434,645

(22) Filed: Jun. 7, 2019

(65) Prior Publication Data

US 2020/0384606 A1 Dec. 10, 2020

(51) Int. Cl.
*B24B 37/26* (2012.01)

(52) U.S. Cl.
CPC ..... *B24B 37/26* (2013.01)

(58) Field of Classification Search
CPC ..... B24B 37/20; B24B 37/22; B24B 37/26
See application file for complete search history.

(56) References Cited

U.S. PATENT DOCUMENTS 5,578,362 A * 11/1996 Reinhardt ..... B24B 53/017 428/313.5
6,387,459 B1 * 5/2002 Weder ..... B44C 3/02 428/458
D488,306 S * 4/2004 Delaney ..... D5/58
6,817,926 B2 11/2004 Kollodge et al.
7,226,345 B1 6/2007 Dornfeld et al.
7,517,277 B2 4/2009 Muldowney
9,649,742 B2 5/2017 Lefevre et al.
2002/0151253 A1 * 10/2002 Kollodge ..... B24B 37/04 451/41
2004/0003895 A1 * 1/2004 Amano ..... B24B 37/245 156/345.12
2014/0273777 A1 * 9/2014 Lefevre ..... B24B 37/26 451/529
2016/0001423 A1 * 1/2016 Esteban ..... B24B 37/245 451/527
2017/0095903 A1 * 4/2017 Galpin ..... B24B 53/017
2018/0086957 A1 * 3/2018 Sahlin ..... C08K 3/16

OTHER PUBLICATIONS

Meeten, Squeeze flow between plane and spherical surfaces, Rheol Acta (2001) 40: 279-288.

* cited by examiner

*Primary Examiner* — Joel D Crandall
(74) *Attorney, Agent, or Firm* — Blake T. Biederman

(57) ABSTRACT

A polishing pad useful in chemical mechanical polishing comprises a base, and a plurality of structures protruding from the base wherein a portion of the plurality of structures are defined by a cross section having a perimeter which defines an area. The perimeter can be defined by parametric equations and can have six or more inflection points or the cross-section can comprise three or more lobes. The cross-section has a Delta parameter in the range of 0.2 to 0.75.

10 Claims, 4 Drawing Sheets

CMP POLISHING PAD WITH LOBED PROTRUDING STRUCTURES

FIELD OF THE INVENTION

The present invention relates generally to the field of polishing pads for chemical mechanical polishing. In particular, the present invention is directed to a chemical mechanical polishing pad having a polishing structure useful for chemical mechanical polishing of magnetic, optical and semiconductor substrates, including front end of line (FEOL) or back end of line (BEOL) processing of memory and logic integrated circuits.

BACKGROUND

In the fabrication of integrated circuits and other electronic devices, multiple layers of conducting, semiconducting and dielectric materials are deposited onto and partially or selectively removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical deposition (ECD), among others. Common removal techniques include wet and dry isotropic and anisotropic etching, among others.

As layers of materials are sequentially deposited and removed, the uppermost surface of the wafer becomes non-planar. Because subsequent semiconductor processing (e.g., photolithography, metallization, etc.) requires the wafer to have a flat surface, the wafer needs to be planarized. Planarization is useful for removing undesired surface topography and surface defects, such as rough surfaces, agglomerated materials, crystal lattice damage, scratches and contaminated layers or materials. In addition, in damascene processes a material is deposited to fill recessed areas created by patterned etching but the filling step can be imprecise and overfilling is preferable to underfilling of the recesses. Thus, material outside the recesses needs to be removed.

Chemical mechanical planarization, or chemical mechanical polishing (CMP), is a common technique used to planarize or polish workpieces such as semiconductor wafers and to remove excess material in damascene processes. In conventional CMP, a wafer carrier, or polishing head, is mounted on a carrier assembly. The polishing head holds the wafer and positions the wafer in contact with a polishing surface of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer traverses a typically annular polishing track, or polishing region, wherein the wafer's surface directly confronts the polishing layer. The wafer surface is polished and made planar by chemical and mechanical action of the polishing surface and polishing medium (e.g., slurry) on the surface.

The interaction among polishing layers, polishing media and wafer surfaces during CMP has been the subject of increasing study, analysis, and advanced numerical modeling in the past years in an effort to optimize polishing pad designs. Most of the polishing pad developments since the inception of CMP as a semiconductor manufacturing process have been empirical in nature, involving trials of many different porous and non-porous polymeric materials and mechanical properties of such materials. Much of the design of polishing surfaces, or layers, has focused on providing these layers with various microstructures, or patterns of void areas and solid areas, and macrostructures, or arrangements of surface perforations or grooves, that are claimed to increase polishing rate, improve polishing uniformity, or reduce polishing defects (scratches, pits, delaminated regions, and other surface or sub-surface damage). Over the years, quite a few different microstructures and macrostructures have been proposed to enhance CMP performance. See e.g. U.S. Pat. Nos. 6,817,926; 7,226,345; 7,517,277; or 9,649,742.

Among the various previously proposed structures are structures having protruding structures for example the shapes of prisms, pyramids, truncated pyramids, cylinders, truncated cones, crosses, heaxagons (see U.S. Pat. No. 6,817,926), or reservoirs defined by raised "c" or "v" shapes and/or "jagged edges" or hexagonal boundaries (see U.S. Pat. No. 7,226,345) or quadrilaterals (including with arced sides or notched corners) (see U.S. Pat. No. 9,649,742).

There remains a need for an improved pad structure having protruding structures which provides good contact to the surface being polished with reasonable force and effective polishing in a reasonable time without undue wear on the pad or other negative consequences.

SUMMARY OF THE INVENTION

Disclosed herein, according to an aspect, is polishing pad useful in chemical mechanical polishing comprising a base and a plurality of structures protruding from the base wherein a portion of the plurality of structure are defined by a cross section having a perimeter which defines an area, where the perimeter is defined by parametric equations on an x-y axis of $$x:=(a1*\sin(2*f1*\pi*t)+a3*\sin(2*f3*\pi*t)+a5*\sin(2*f5*\pi*t))/G1$$

$$y:=(a2*\cos(2*f2*\pi*t)+a4*\cos(2*f4*\pi*t)+a6*\cos(2*f6*\pi*t))/G2$$

where a1, a2, a3, a4, a5, a6 each are independently numbers from $-10^{12}$ to $10^{12}$, and f1, f2, f3, f4, f5, f6 are each numbers from 0 to $10^{12}$, t is a parametric independent variable which increases in increments, delta t, from 0 to 1 to define the perimeter and delta t is preferably no more than 0.05, and G1 and G2 are scaling parameters that range from greater than 0 to $10^{12}$, provided a1, a2, a3, a4, a5, a6; f1, f2, f3, f4, f5, f6 are selected such that the perimeter has six or more inflection points where the perimeter switches from concave to convex curve and the perimeter does not intersect with itself except where it starts and ends; wherein the cross-section is further characterized by a Delta parameter that is in a range from 0.20 to 0.75. "Delta parameter" is defined as (the distance of a point inside the perimeter and furthest from the perimeter to a closest point on the perimeter) divided by (the equivalent radius of a circle having an area equal to the area of the cross section). The equivalent radius is the square root of (Area of the cross-section/it).

According to another aspect, disclosed herein is a polishing pad comprising a base and a plurality of structures protruding from the base wherein a portion of the plurality of structures have three or more lobes and are defined by a cross section having a perimeter which defines an area, wherein the cross-section is characterized by a Delta parameter in a range from 0.3 to 0.65.

DETAILED DESCRIPTION OF THE INVENTION

Figure 1:
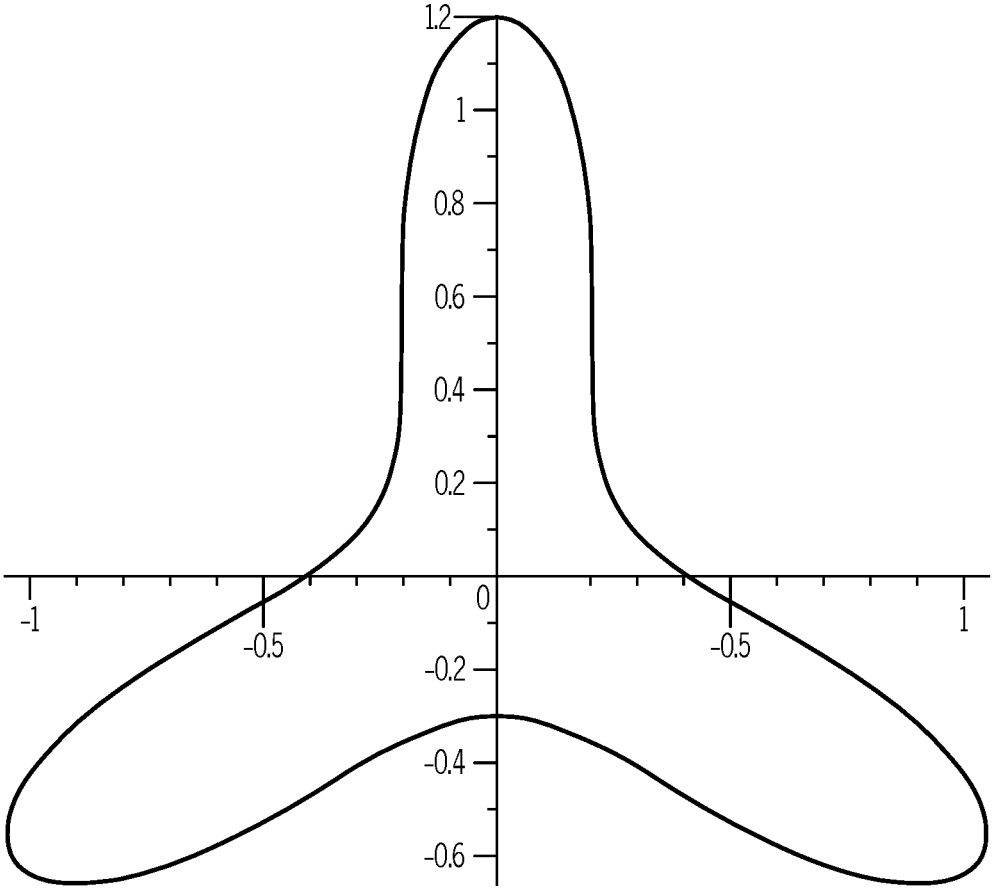
FIG. 1 is a representative embodiment of a cross-section of a protruding structure as may be used on a pad of the invention.

In a pad having protruding structures in the form of cylinders, polygons (e.g. rectangular, truncated pyramids, hexagons) or the like, Applicants have found there are certain problems as the protruding structure approaches the surface to be polished. One problem is that the fluid (e.g. polishing slurry) traverses a very long length across the top of the protruding structure(s). This increases the pressure of the fluid on top of the feature which decreases pad-wafer contact area and contact stress. This reduces removal rate.

Stated another way, a force is required to push the protruding structure toward the surface. However, the distance between the surface and the top of the protruding structure for a given force increases with the top surface area of the protruding structure and viscosity of the fluid. For example for a cylindrical protruding structure, the force, F, on an individual protruding structure can be calculated as follows:

$$-F = \frac{3}{32}\frac{\pi\eta d^4 \frac{dh(t)}{dt}}{h(t)^3},$$

and the time to achieve contact, $t_{contact}$, between the top of the protrusion and the surface to be polished can be calculated as $$t_{contact} = \frac{3}{64}\frac{\pi\eta d^4}{F}\left(\frac{1}{h_c^2} - \frac{1}{h_0^2}\right)$$

where d is cylinder diameter, ho is initial separation distance of the protruding structure from the surface to be polished, $h_c$, is separation distance when sufficient contact is deemed to occur, η, is the viscosity of the fluid (e.g. the polishing slurry). See Geral Henry Meeten, *Squeeze flow between plane and spherical surfaces*. Rheol. Acta (2001) 40: 279-288.

Thus, it is sometimes difficult to achieve sufficient closeness of the protruding structure to the surface which is being polished to have effective polishing in a reasonable time. If the time is higher to achieve contact, however, then the speeds of movement of the polishing pad and the surface relatively to each other are lower. This leads to a lower removal rate because the protruding structures will not be able to impart sufficient energy to the surface to be polished. To improve contact one may contemplate lowering the area of the protruding structures by reducing the number of protruding structures on the pad (or increase the spacing of the protruding structures, i.e. pitch), but that can lead to less total work (less polishing) being done by the pad, or possibly to increased wear and more buckling, bending or deflection as each protruding structure bears a larger force for a given force exerted on the pad as a whole. Reducing the size of a protruding structure (particularly the size of the surface of the protruding structure facing the surface being polished—e.g. diameter of cylinder or length of side of square), can also lead to buckling, bending or deflection of the protruding structure and/or unwanted wear (e.g. tearing of the protruding structures). Increasing the height of the protruding structure can facilitate fluid management but can also lead to buckling, bending or deflection and potentially tearing of the protruding structure.

The pad disclosed herein has protruding structures that reduce the distance the fluid (slurry) has to travel over the top surface of the protruding structure which enables better contact to the surface being polished while maintaining sufficient structural or mechanical strength to avoid deflection or tearing. Specifically, the pad disclosed herein provides protruding structures that have a cross section with three or more lobes. Thus, the distance fluid travels over a continuous top surface of a protruding structure can be reduced while the lobes can reinforce each other for mechanical integrity, inhibiting deflection of the structure.

A protruding structure can have a cross section defined by parametric equations on an x-y axis of $$x:=(a1*\sin(2*f1*\pi*t)+a3*\sin(2*f3*\pi*t)+a5*\sin(2*f5*\pi*t))/G1$$

$$y:=(a2*\cos(2*f2*\pi*t)+a4*\cos(2*f4*\pi*t)+a6*\cos(2*f6*\pi*t))/G2$$

where a1, a2, a3, a4, a5, a6 each are independently numbers from $-10^{12}$ to $10^{12}$, and f1, f2, f3, f4, f5, f6 are each independently numbers from 0 to $10^{12}$, t is a parametric independent variable which increases in increments, delta t, from 0 to 1 to define the perimeter and delta t is preferably no more than 0.05, and G1 and G2 are scaling parameters that range from greater than 0 to $10^{12}$. In certain embodiments, a1, a2, a3, a4, a5, a6 each are independently numbers of at least −100 or −10 up to 10o or 10. In certain embodiments, and f1, f2, f3, f4, f5, f6 are each independently numbers of 0 to 100 or 10. In certain embodiments G1 and G2 independently range from greater than 0 to 100 or 10. For example, in FIG. 1, a1=3, a2=3, a3=−1.3, a4=1.3, a5=0.5, a6=0.5, f1=1, f2=1, f3=2, f4=2, f5=4, f6=4. The delta t used was 0.002. G1 and G2 were 3.

According to certain aspects, delta t is no more than 0.01, or 0.005, or or 0.002 or 0.001. The smaller delta t is, the more points will be made to define the shape.

According to an aspect the equations define a perimeter of a protruding structure that has at least 6 inflection points where the perimeter switches from concave to convex curve and the perimeter does not intersect with itself except where it starts and ends. For example, it can have 6, 8, 10, 12, 14, 16 or 18 inflection points. According to one aspect the perimeter has 6 inflection points. Variables a1, a2, a3, a4, a5, a6; f1, f2, f3, f4, f5, f6 are selected so as to form a shape with the desired number of inflection points.

The variables a1, a2, a3, a4, a5, a6; f1, f2, f3, f4, f5, f6 are selected such that the equation defines a perimeter starting and ending at the same point to form a continuous perimeter that does not cross over itself.

While FIG. 1 shows a symmetric structure, a protruding structure need not have a symmetric structure. For example, lobes do not have to be the same size measured as length from feature center to the furthest point, do not have to have the same radius of curvature and/or do not have to have the same width.

According to an aspect, a protruding structure can have 3 or more lobes. For example, it can have 3, 4, 5, 6, 7 or 8 lobes. According to one aspect, a protruding structure has 3 lobes.

Figure 2:
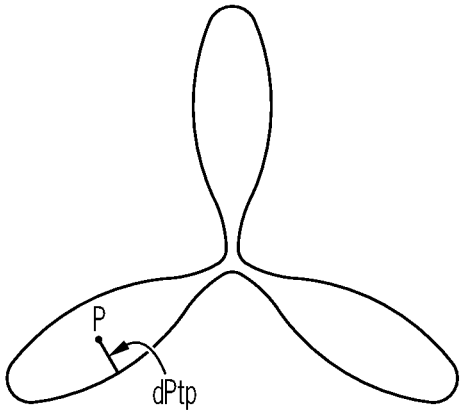
FIG. 2 is a representative embodiment of a cross-section of a protruding structure as may be used on a pad of the invention.
Figure 3:
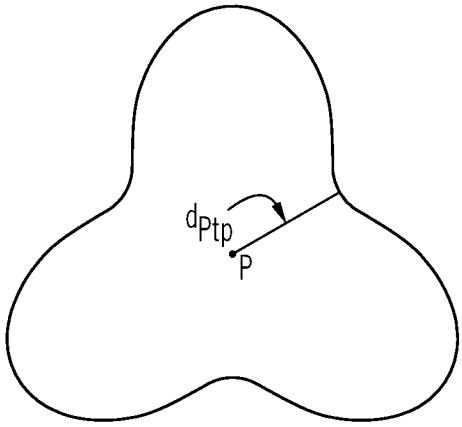
FIG. 3 is a representative embodiment of a cross-section of a protruding structure as may be used on a pad of the invention.
Figure 4:
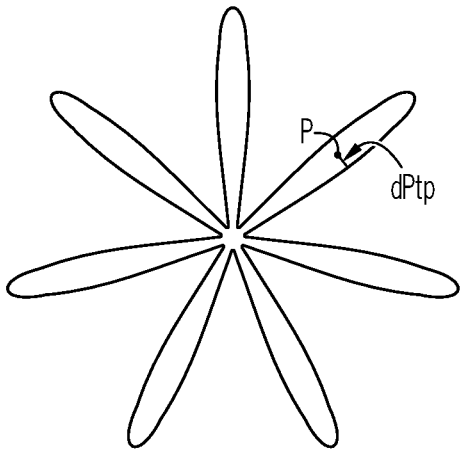
FIG. 4. is an embodiment of a cross section of a protruding structure having a Delta circularity parameter of 0.15.

According to an aspect a cross section of a protruding structure is defined by a Delta parameter. The Delta parameter equals (a distance, $d_{Ptp}$, of a point, P, inside the perimeter and furthest from the perimeter to the closest point on the perimeter) divided by (an equivalent radius of a circle having an area equal to the area of the cross section). An equivalent radius=square root (A/it). Thus, referring to FIGS. 2, 3, and 4 the Delta parameter=distance $d_{Ptp}$/equivalent radius. For FIG. 2, the Delta parameter is 0.34, and for FIG. 3 the Delta parameter is 0.65 and for FIG. 4, the Delta parameter is 0.15. According to certain aspects, the Delta parameter is at least 0.2. The Delta parameter is no more than 0.75. According to certain aspects the Delta parameter is at least 0.25, or 0.3 or 0.35, or 0.4. According to certain aspects the Delta parameter is no more than 0.7 or 0.65 or 0.6. FIG. 1 has a Delta parameter of 0.46. If a Delta parameter is too low, a protruding structure may have narrow arms or lobes that do not provide desired mechanical strength or integrity. If a Delta parameter is too high, the polishing slurry traverses a long length across the top of the protruding structure. This increases the pressure of the fluid on top of the feature that decreases pad-wafer contact area and contact stress. This reduces removal rate.

According to an aspect, a protruding structure can have a constant cross section over the entire height of the structure. According to another aspect, the cross section may vary over the height of a protruding structure. For example, a protruding structure for stability may have a slightly broader or larger cross section closer to the base. According to another aspect, the sum of the cross sections of the multitude of protruding structures is constant such as to provide a consistent area of contact as the structures are worn down during use. Thus if one or more of the protruding structures is narrower at the top, others of the structures may be broader at the top leading to a constant total area of cross section.

According to certain aspects, a height of a protruding structure can be in the range of at least 0.05 or 0.1 mm up to 3 or 2.5 or 2 or 1.5 mm from the top surface of the base. According to certain aspects, a cross-section area of a protruding structure can be in the range of 0.05 or 0.1 or 0.2 $mm^2$ to 30 or 25 or 20 or 15 or 10 or 5 $mm^2$. According to certain aspects the longest dimension of the cross section of a protruding structure (e.g. the longest distance a fluid would travel across the top surface of a protruding structure) is at least 0.1 or 0.5 mm or 1 mm. According to certain aspects the longest dimension of the cross section of a protruding structure (e.g. the longest distance a fluid would travel across the top surface of a protruding structure) is no more than 100 or 50 or 20 or 10 or 5 or 3 or 2 mm. According to certain aspects the shortest dimension of the cross section of a structure (e.g. the shortest distance a fluid would travel across the top surface of a protruding structure, for example the distance across one lobe) is at least 0.01 or 0.05 or 0.1 or 0.5 mm. According to certain aspects the shortest dimension of the cross section of a structure (e.g. the shortest distance a fluid would travel across the top surface of a protruding structure, for example the distance across one lobe) is not more than 5 or 3 or 2 or 1 mm.

The structures protrude from a top surface of the base of the pad. The base of the pad may be a layer comprising any material suitable for supporting the protruding structures. For example the base layer may comprise or may consist of a polymeric material. Examples of such polymeric materials include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

Preferably, the matrix is a polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to form the polishing layer by skiving a cast polyurethane cake to a desired thickness and grooving or perforating the polishing layer. Optionally, preheating a cake mold with IR radiation, induction or direct electrical current can reduce product variability when casting porous polyurethane matrices. Optionally, it is possible to use either thermoplastic or thermoset polymers. Most preferably, the polymer is a crosslinked thermoset polymer.

Preferably, the polyfunctional isocyanate used in the formation of the polishing layer of the chemical mechanical polishing pad of the present invention is selected from the group consisting of an aliphatic polyfunctional isocyanate, an aromatic polyfunctional isocyanate and a mixture thereof. More preferably, the polyfunctional isocyanate used in the formation of the polishing layer of the chemical mechanical polishing pad of the present invention is a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. Still more preferably, the polyfunctional isocyanate used in the formation of the polishing layer of the chemical mechanical polishing pad of the present invention is an isocyanate terminated urethane prepolymer formed by the reaction of a diisocyanate with a prepolymer polyol.

Preferably, the isocyanate-terminated urethane prepolymer used in the formation of the polishing layer of the chemical mechanical polishing pad of the present invention has 2 to 12 wt % unreacted isocyanate (NCO) groups. More preferably, the isocyanate-terminated urethane prepolymer used in the formation of the polishing layer of the chemical mechanical polishing pad of the present invention has 2 to 10 wt % (still more preferably 4 to 8 wt %; most preferably 5 to 7 wt %) unreacted isocyanate (NCO) groups.

Preferably the prepolymer polyol used to form the polyfunctional isocyanate terminated urethane prepolymer is selected from the group consisting of diols, polyols, polyol diols, copolymers thereof and mixtures thereof. More preferably, the prepolymer polyol is selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. Still more preferably, the prepolymer polyol is selected from the group consisting of polytetramethylene ether glycol (PTMEG); ester based polyols (such as ethylene adipates, butylene adipates); polypropylene ether glycols (PPG); polycaprolactone polyols; copolymers thereof and, mixtures thereof. Most preferably, the prepolymer polyol is selected from the group consisting of PTMEG and PPG.

Preferably, when the prepolymer polyol is PTMEG, the isocyanate terminated urethane prepolymer has an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF).

Preferably, when the prepolymer polyol is PPG, the isocyanate terminated urethane prepolymer has an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and, Andur® prepolymers (available from Anderson Development Company, such as, 8000APLF, 9500APLF, 6500DPLF, 7501DPLF).

Preferably, the isocyanate terminated urethane prepolymer used in the formation of the polishing layer of the chemical mechanical polishing pad of the present invention is a low free isocyanate terminated urethane prepolymer having less than 0.1 wt % free toluene diisocyanate (TDI) monomer content.

Non-TDI based isocyanate terminated urethane prepolymers can also be used. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE 85AP, IE90AP, IE95AP, IE98AP); and, Vibrathane® prepolymers (available from Chemtura, such as, B625, B635, B821).

The base layer may comprise composite of a polymeric material with other materials. Examples of such composites include polymers filled with carbon or inorganic fillers and fibrous mats of, for example glass or carbon fibers, impregnated with a polymer. Any of the preceding polymers or epoxy resins could be used in such composite materials. Alternatively the base may comprise a non-polymeric material such as ceramic, glass, metal, stone or wood. The base can comprise one layer or can comprise more than one layer of any suitable material, such as those recited above. The base may be provided on a subpad. For example, the base layer may be attached to a subpad via mechanical fasteners or by an adhesive. The subpad can be made from any suitable material, including for examples the materials useful in the base layer. The base layer in some aspects can have a thickness of at least 0.5 or 1 mm. The base layer in some aspects can have a thickness of no more than 5 or 3 or 2 mm. The base layer can be provided in any shape but it can be convenient to have a circular or disc shape with a diameter in the range of at least 10 or 20 or 30 or 40 or 50 cm to 100 or 90 or 80 cm. According to certain embodiments the base of the pad is made of a material having one or more of the following properties: a Young's modulus as determined, for example, by ASTMD412-16 in the range of at least 2 or 2.5 or 5 or 10 or 50 MPa to 700 or 600 or 500 or 400 or 300 or 200 or 100 MPa, a Poisson's ratio as determined, for example, by ASTM E132015 of at least 0.05 or 0.08 or 0.1 to 0.6 or 0.5; a density of 0.4 or 0.5 to 1.7 or 1.5 or 1.3 g/cm$^3$.

At least a portion of the structures protruding from the surface have the shape (cross-section and perimeter) as defined by 3 or more lobes or 6 or more inflection points and by Delta parameter in the ranges as described herein, e.g., 0.2 to 0.75. According to an aspect all the protruding structures have a cross section defined by 3 or more lobes or 6 or more inflection points and by Delta parameter in the ranges as described herein e.g., 0.2 to 0.75. All the protruding structures may have the same cross section or different protruding structures may have different cross sections. For example, some protruding structures may have longer or wider or shorter or narrower lobes than another protruding structure. For example, some of the protruding structures may have three lobes while other protruding structures have four or more lobes. For example, as long as some of the protruding structures may have the cross section defined by 3 or more lobes or by 6 or more inflection points and by Delta parameter in the range or 0.2 to 0.75, the pad may include other protruding structures may have other shapes such circular, elliptical or other polygonal shapes, such square, triangles, pyramids, etc. Preferably, at least 50 to 60 or 70 or 80 percent of the protruding structures on a pad have the cross section defined by 3 or more lobes or by 6 or more inflection points and by Delta parameter in the range or 0.2 to 0.75. If the Delta parameter is too low, the protruding structures may have arms or lobes that are too thin to provide the desired mechanical support. If the Delta parameter is too high, the protruding structure is too round and the time to achieve contact is too long to provide the desired removal rate.

Figure 5:
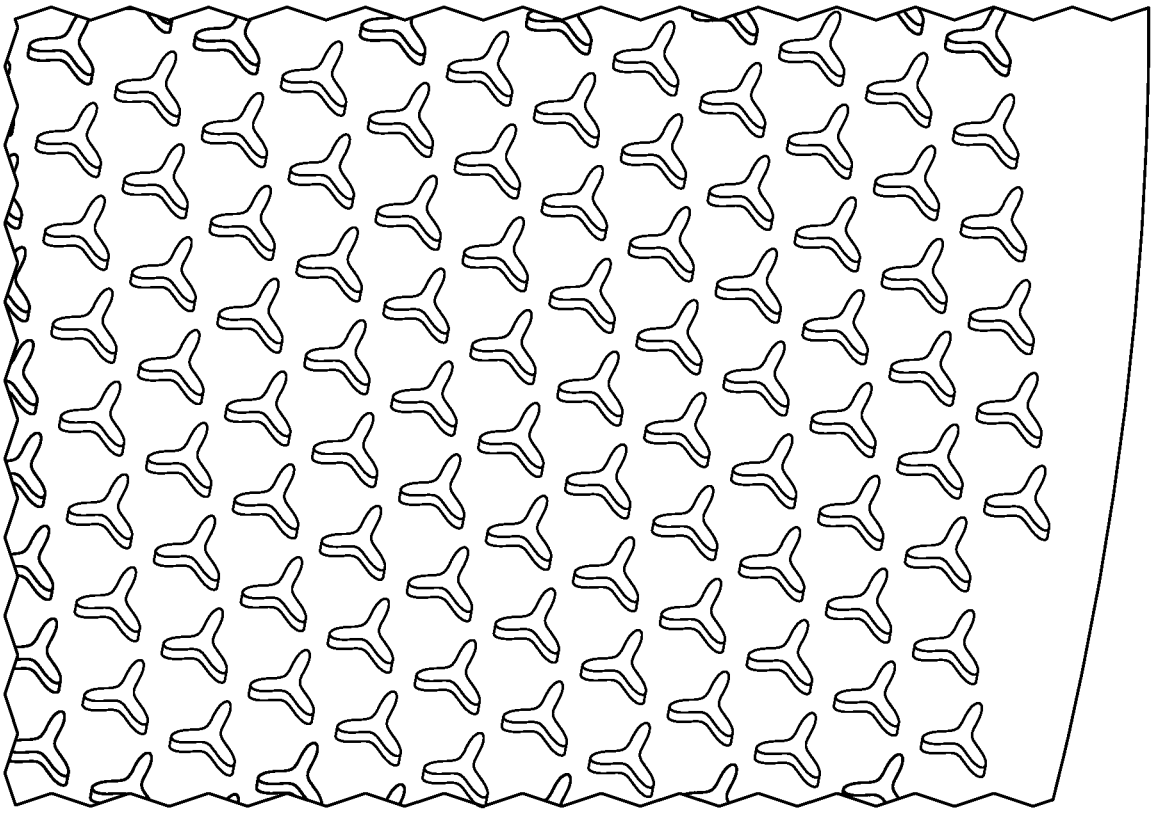
FIG. 5 shows a portion of a pad having three-lobed protruding structures thereon.

The protruding structures can be arranged in any configuration on the working surface. In one embodiment they can be arranged in a hexagonal packing structure oriented in the same direction. In another embodiment they can be arranged in a radial pattern oriented such that one lobe aligns with the radial. The protruding structures do not need to be oriented with any macroscale orientation. Macroscale orientation may be adjusted to achieve desired removal rate, planarization effect, control of defectivity, control of uniformity, and as needed for desired slurry amount. As one example see FIG. 5 showing a plurality of three lobed protruding structures on a portion of a pad in a hexagonal packing pattern.

Preferably, the protruding structures do not directly contact each other. The spacing between adjacent protruding structures can, but does not have to be, constant. According to certain embodiments the structures are spaced at a distance from center of one protruding structure to center of an adjacent protruding structure, i.e. a pitch, of up to 50 or 20 or 10 or 7 or 5 or 4 times a longest dimension of the cross section of the protruding structure. According to certain embodiments, the structures are spaced at a distance from center of one protruding structure to center of an adjacent protruding structure of at least 1, 1.5, or 2 times the longest dimension of the cross section of the protruding structure. As an example of low pitch configurations, they may be placed such that a lobe of a first protruding structure may be positioned between two lobes of an adjacent protruding structure without direct contact between the first protruding structure and the adjacent protruding structure. According to certain embodiments the pitch (distance from center of one protruding structure to center of an adjacent protruding structure) is at least 0.7 or 1 or 5 or 10 or 20 mm. According to certain embodiments the pitch (distance from center of one protruding structure to center of an adjacent protruding structure) is no more than 150 mm or 100 mm or 50 mm. According to certain embodiments the distance from the perimeter of one protruding structure to a nearest perimeter of an adjacent protruding structure is as least 0.02 or 0.05 or 0.1 or 0.5 or 1 mm. According to certain embodiments, the distance from the perimeter of one protruding structure to a nearest perimeter of an adjacent protruding structure is no more than 100 or 50 or 20 or 10 or 5 mm.

Figure 6:
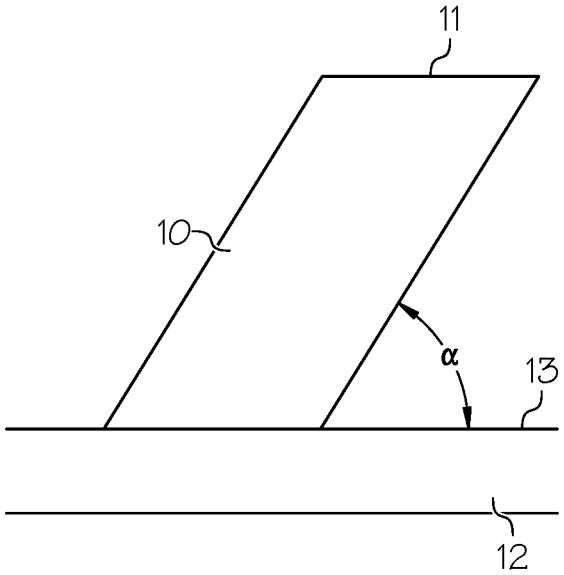
FIG. 6 shows a protruding structure orientation relative to the surface of the base of a pad.

According to one aspect a protruding structure is normal or substantially orthogonal in its main axis of its height relative to the surface of the base. In that case, angle, a, between the base 12 and the protruding structure 10 in FIG. 6 is 90 degrees. The top surface 11 of the protruding structure 10 is according to certain embodiments parallel to the top surface 13 of the base 12. According to another embodiment a protruding structure may be slanted or tilted such that a is less than 90 degrees. However a is preferably at least 20 or 40 or 60 or 70 or 80 degrees.

The contact area ratio is cumulative surface contact area, $A_{cpsa}$, or the plurality of protruding structures divided by the area of the base, $A_b$. The cumulative surface contact area can be calculated by adding the area of the top surfaces 11 of all of the protruding structures. Since pads are conventionally circular, for a conventional pad shape $\pi(r_b)^2$, where $r_b$ is the radius of the pad. According to certain embodiments ratio of $A_{cpsa}/A_b$ is at least 0.1 or 0.2 or 0.3 or 0.4 and is no more than 0.8 or 0.75 or 0.7 or 0.65 or 0.6.

A protruding structure and the base may be a unitary body or the protruding structure may be placed on and adhered to the base.

The composition of the protruding structures may be the same or different from the composition of the base. For example, a protruding structure may comprise or may consist of a polymeric material. Examples of such polymeric materials include polycarbonates, polysulfones, nylons, polyethers, epoxy resins, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof. The protruding structure may comprise composite of a polymeric material with other materials. Examples of such composites include polymers filled with carbon or inorganic fillers. According to certain embodiments, protruding structure(s) are made of a material having one or more of the following properties: a Young's modulus as determined, for example, by ASTMD412-16 in the range of at least 2 or 2.5 or 5 or 10 or 50 MPa to 700 or 600 or 500 or 400 or 300 or 200 or 100 MPa, a Poisson's ratio as determined, for example, by ASTM E132015 of at least 0.05 or 0.08 or 0.1 to 0.6 or 0.5; a density of 0.4 or 0.5 to 1.7 or 1.5 or 1.3 g/cm$^3$.

The pad may be made by any suitable process. For example, the pad may be made by molding—e.g. injection molding—where the mold includes indentations that are used to form the protruding structures of the pad. As another example, the pad may be made by additive manufacturing by known method and the protruding structures are built up on a provided base of the pad by such additive manufacturing or the entire pad could be made by additive manufacturing.

Test methods are those in effect as of the date of filing of this application.

What is claimed is:

1. A polishing pad useful in chemical mechanical polishing comprising a base, and a plurality of structures protruding from the base wherein a portion of the plurality of structures are defined by a cross section having a perimeter that defines an area, where the perimeter is defined by parametric equations on an x-y axis of $$x:=(a1*\sin(2*f1*\pi*t)+a3*\sin(2*f3*\pi*t)+a5*\sin(2*f5*\pi*t))/G1$$

$$y:=(a2*\cos(2*f2*\pi*t)+a4*\cos(2*f4*\pi*t)+a6*\cos(2*f6*\pi*t))/G2$$

where a1, a2, a3, a4, a5, a6 each are independently numbers from $-10^{12}$ to $10^{12}$, and f1, f2, f3, f4, f5, f6 are each numbers from 0 to $10^{12}$, t is a parametric independent variable that increases in increments, delta t, from 0 to 1 to define the perimeter and delta t is no more than 0.05, and G1 and G2 are scaling parameters that range from greater than 0 to $10^{12}$, provided a1, a2, a3, a4, a5, a6; f1, f2, f3, f4, f5, f6 are selected such that the perimeter has six or more inflection points where the perimeter switches from concave to convex curve and the perimeter does not intersect with itself except where the perimeter starts and ends; wherein the cross-section is further characterized by a Delta parameter that is equal to a distance of a point inside the perimeter and furthest from the perimeter to a closest point on the perimeter divided by an equivalent radius of a circle having an area equal to the area of the cross section where the Delta parameter is in a range of 0.20 to 0.75.

2. The polishing pad of claim 1 wherein there are six inflection points.

3. The polishing pad of claim 1 wherein the Delta parameter is at least 0.3.

4. The polishing pad of claim 1 wherein the Delta parameter is no more than 0.6.

5. A polishing pad comprising a base, and a plurality of structures protruding from the base wherein a portion of the plurality of structures have three or more lobes and the plurality of structures are defined by a cross section having a perimeter that defines an area, wherein the cross-section is characterized by a Delta parameter that is equal to a distance of a point inside the perimeter and furthest from the perimeter to a closest point on the perimeter divided by an equivalent radius of a circle having an area equal to the area of the cross section where the Delta parameter is in a range of 0.3 to 0.6.

6. The polishing pad of claim 5 having three lobes.

7. The polishing pad of claim 5 wherein the portion is all of the plurality of the structures.

8. The polishing pad of claim 5 wherein a distance from the base to a top surface of the plurality of structures is in the range of 0.1 to 2 mm.

9. The polishing pad of claim 5 wherein the pad is formed from at least one material having one or more of the following properties:

a Young's modulus in the range of 2.5 to 700 MPa, a Poisson's ratio of 0.08 to 0.5, a density of 0.4 to 1.5 g/cm$^3$.

10. The polishing pad of claim 5 wherein the plurality of structures has a cumulative surface contact area, $A_{cpsa}$, and the base has an area, $A_b$, wherein the ratio of $A_{cpsa}/A_b$ is in the range of 0.1 to 0.75.

* * * * *